United States Patent [19]

Tait et al.

[11] Patent Number: 4,950,383

[45] Date of Patent: Aug. 21, 1990

[54] PROCESS FOR UPGRADING SHALE OIL

[75] Inventors: Andrew M. Tait, Naperville, Ill.; Albert L. Hensley, Jr., Munster, Ind.

[73] Assignee: The United States of America as represented by the Secretary of the Air Force, Washington, D.C.

[21] Appl. No.: 448,186

[22] Filed: Dec. 8, 1989

[51] Int. Cl.[5] ..... C10G 11/04

[52] U.S. Cl. ..... 208/59; 208/111; 208/112; 208/210; 502/66; 502/73; 502/305; 502/314; 502/315

[58] Field of Search ..... 208/59, 111, 112, 210; 502/66, 73, 84, 305, 314, 315, 335, 337, 64, 439, 79

[56] References Cited

U.S. PATENT DOCUMENTS

| | | | |
|---|---|---|---|
| 3,224,954 | 12/1965 | Schlinger et al. | 208/11 |
| 3,243,367 | 3/1966 | Mason et al. | 208/59 |
| 3,287,252 | 11/1966 | Young | 208/59 |
| 3,549,515 | 12/1970 | Brainard et al. | 208/59 |
| 3,565,784 | 2/1971 | Schlinger et al. | 208/11 |
| 4,032,429 | 6/1977 | Cronauer et al. | 208/10 |
| 4,188,801 | 1/1980 | Breuker et al. | 208/59 |
| 4,211,634 | 7/1980 | Bertolacini et al. | 208/59 |
| 4,356,079 | 10/1982 | Desaau | 208/10 |
| 4,493,761 | 1/1985 | Hensley et al. | 502/66 |
| 4,618,594 | 10/1986 | Tait et al. | 208/10 |
| 4,620,922 | 11/1986 | Tait et al. | 208/254 H |
| 4,738,768 | 4/1988 | Tait et al. | 208/111 |
| 4,771,027 | 9/1988 | Tait et al. | 502/257 |
| 4,797,195 | 1/1989 | Kukes et al. | 208/59 |
| 4,797,196 | 1/1989 | Kukes et al. | 208/59 |
| 4,834,865 | 5/1989 | Kukes et al. | 208/59 |

*Primary Examiner*—Helane Myers

*Attorney, Agent, or Firm*—Charles E. Bricker; Donald J. Singer

[57] ABSTRACT

A process for hydrocracking a hydrocracking feedstock with hydrogen at hydrocracking conversion conditions which comprises contacting the feedstock with a first catalyst comprising a nickel component, a molybdenum component and a phosphorus component deposited on a support component consisting essentially of a refractory metal oxide, and a second catalyst comprising a cobalt component, a chromium component and a molybdenum component deposited on a support component consisting essentially of a refractory metal oxide component and a molecular sieve component.

This process is particularly suitable for the hydrocracking of shale oil feedstocks which typically have high nitrogen contents, i.e., total nitrogen at least about 0.2 wt %.

10 Claims, No Drawings

PROCESS FOR UPGRADING SHALE OIL

RIGHTS OF THE GOVERNMENT

The invention described herein may be manufactured and used by or for the Government of the United States for all governmental purposes without the payment of any royalty.

BACKGROUND OF THE INVENTION

This present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support. More specifically, hydrocracking catalysts comprise a hydrogenation component selected from the group consisting of Group VIB metals and Group VIII metals of the Periodic Table of Elements, their oxides or sulfides. These hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component, the preferred Group VIB metals are tungsten and molybdenum; the preferred Group VIII metals are nickel and cobalt. The prior art has also taught that combinations of metals for the hydrogenation components, expressed as oxides and in the order of preference, are: NiO—$WO_3$, NiO—$MoO_3$, CoO—$MoO_3$, and CoO—$WO_3$. Other hydrogenation components broadly taught by the prior art include iron, ruthenium, rhodium, palladium, osmium, indium, platinum, chromium, vanadium, niobium, and tantalum.

There is a myriad of catalysts or catalyst systems known for hydrocracking whose properties vary widely. A catalyst suitable for maximizing naphtha yield may not be suitable for maximizing the yield of turbine fuel or distillate. Further, various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity component that is capable of being poisoned. Another difficulty is presented when a hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatic content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contracting with a hydrocracking catalyst which contained a high amount of cracking component; i.e., a molecular sieve material.

Accordingly, it is an object of the present invention to provide a process for hydrocracking a hydrocracking feedstock.

More particularly, it is an object of the present invention to provide a process for upgrading crude shale oil to distillate fuels.

Other objects and advantages of the present invention will be apparent to those skilled in the art.

SUMMARY OF THE INVENTION

In accordance with the present invention there is provided a process for hydrocracking a hydrocracking feedstock with hydrogen at hydrocracking conversion conditions which comprises contacting the feedstock with a first catalyst comprising a nickel component, a molybdenum component and a phosphorus component deposited on a support component consisting essentially of a refractory metal oxide, and a second catalyst comprising a cobalt component, a chromium component and a molybdenum component desposited on a support component consisting essentially of a refractory metal oxide component and a molecular sieve component.

DETAILED DESCRIPTION OF THE INVENTION

The process of the present invention is particularly suitable for the hydrocracking of shale oil feedstocks which typically have high contents, i.e., total nitrogen at least about 0.2 wt %. Other feedstocks which may be processed in accordance with the invention include petroleum distillates, solvent deasphalted petroleum residues, and cool tar distillates. These feedstocks typically have a boiling range above about 200° F. and generally have a boiling range of about 350° F. to 950° F.

Operating conditions to be used in the process of the invention include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is carried out a reaction zone containing the two catalysts described previously. The reaction zone can comprise one or a plurality of beds that have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit. Alternatively, the process can be carried out in two reaction zones wherein each zone contains a single catalyst.

The catalysts used in the process of the invention comprise a hydrogenation component and a catalyst support.

The first catalyst hydrogenation component comprises nickel, moleybdenum and phosphorus. These elements and/or their compounds are present in the amounts specified below. These amounts are based on the total catalytic composite or catalyst weight and are calculated as the oxides NiO, $MoO_3$ and $P_2O_5$.

| | Broad | Preferred | Most Preferred |
|---|---|---|---|
| NiO, wt % | 0.5–10 | 1–6 | 2–4 |
| $MoO_3$, wt % | 12–22 | 15–20 | 16.5–18.5 |
| $P_2O_5$, wt % | 0.1–3 | 0.5–2.7 | 1.0–2.2 |

The above described hydrogenation components are deposited on a support component consisting essentially of a refractory inorganic oxide. The first catalyst support is essentially devoid of a crystalline molecular sieve component. Preferred refractory molelcular inorganic oxides are silica-alumina, and alumina.

The hydrogenation component of the second catalyst comprises cobalt, chromium and molybdenum and/or their compounds. These elements are present in the amounts specified below. These amounts are based on the total catalytic composite or catalyst weight and are calculated as the oxides.

| | Broad | Preferred | Most Preferred |
|---|---|---|---|
| CoO, wt % | 0.5–5.0 | 0.5–3.0 | 1–2 |
| $Cr_2O_3$, wt % | 5-20 | 5–15 | 8–12 |
| $MoO_3$, wt % | 10–20 | 11–19 | 13–17 |

The above-described components are deposited on a support consisting essentially of a crystalline molecular sieve material and alumina. The crystalline molecular sieve material is present in an amount ranging from about 10 to about 60 wt % based on total weight. Preferably, the crystalline molecular sieve material is distributed throughout and suspended in a porous matrix of the alumina.

In all cases the hydrogenation component may be deposited upon the support by impregnation, employing heat-decomposable salts of the above-described elements or any other methods known to those skilled in the art. Each of the elements may be impregnated onto the support separately, or they may be co-impregnated onto the support. The composites are subsequently dried and calcined to decompose the salts and to remove the undesired anions.

The supports may be prepared by various well-known methods and formed into pellets, beads, and extrudates of the desired size. For example, the crystalline molecular sieve material may be pulverized into finely divided material, and this latter material may be intimately admixed with the refractory inorganic oxide. The finely divided crystalline molecular sieve material may be admixed thoroughly with a hydrosol or hydrogel of the inorganic oxide. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of faujasite type crystalline aluminosilicates, and mordenite-type crystalline aluminosilicates. Although not preferred, crystalline aluminosilicates such as ZSM-5, ZSM-11. ZSM-12, ZSM-23, and ZSM-35, and an AMS-1B crystalline molecular sieve can also be used with varying results alone or in combination with the faujasite-type or mordenite-type crystalline aluminosilicate. Examples of a faujasite-type crystalline aluminosilicate are low-alkali metal Y-type crystalline aluminosilicates, metal exchange X-type and Y-type crystalline aluminosilicates, and ultrastable, large pore crystalline aluminosilicate material, Zelon is an example of a mordenite-type crystalline aluminosilicate.

Ultrastable, large pore crystalline aluminosilicate material is represented by Z-14US zeolites which have been described in the patent art. By large-pore material is meant a material that has pores which are sufficiently large to permit the passage thereinto off benzene molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. The ultrastable, large pore crystalline aluminosilicate material exhibits extremely good stability toward wetting, which is defined as the ability of a particular aluminosilicate material to retain surface area or nitrogen-adsorption capacity after contact with water or water vapor.

The ultrastable, large-pore crystalline aluminosilicate material that is preferred for the catalytic composition of this invention exhibits a cubic unit cell dimension and hydroxyl infrared bands that distinguish it from other aluminosilicate materials. The cubic unit cell dimension of the preferred ultrastable, large pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$(3.745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic preferred ultrastable, large-pore crystalline aluminosilicate material that is used in the catalyst of the present invention.

The ultrastable, large-pore crystalline aluminosilicate material is characterized also by an alkaline metal content less than 1%.

Another example of a crystalline molecular sieve zeolite that can be employed in the catalytic composition of the present invention is a metal-exchanged Y-type molecular sieve. The metal exchange Y-type molecular sieve can be prepared by replacing the original cation associated with the molecular sieve by a variety of other cations according to techniques that are known in the art. Specifically, a mixture of rare earth metals can be exchanges into a Y-type zeolitic molecular sieve and such a rare earth metal-exchanged Y-type molecular sieve can be employed suitably in the catalytic composition of the present invention. Specific examples of suitable rare earth metals are cerium, lanthanum and praseodymium.

The catalysts used in the present invention can be used in any form such as pellets, spheres, extrudates, or other shapes having particular cross sections such as cloverleaf or "C" shaped.

Prior to use in the present invention, the catalysts are subjected to a sulfiding pretreatment. This sulfiding pretreatment is necessary because the metal constituents of the hydrogenation components should be in a partially-reduced state. The sulfiding will provide such partially-reduced metals, but will not reduce the metals completely to the elemental form, which form is inactive.

A convenient sulfiding pretreatment comprises heating the catalysts to a temperature within the range of about 250° F. (121° C.) to about 350° F. (177° C.), passing a gas mixture of hydrogen sulfide in hydrogen over and through the catalysts at a variable pressure for a period of about 0.5 hour to about 2 hours, raising the temperature to a value within the range of about 350° F. (177° C.) to about 450° F. (232° C.), continuing to pass the gas mixture at this latter temperature over and through the catalyst for an additional period of about 0.5 hour to about 2 hours, raising the temperature to a value of about 650° F. (343° C.) to about 750° F. (399° C.), and continuing to pass the hydrogen sulfide/hydrogen gas mixture through the catalyst for an additional period of about 0.5 hour to about 2 hours. Sufficient gas should be employed to provide at least 100% and preferably about 110% of the stoichiometric amount of hydrogen sulfide needed to sulfide the metals of the hydrogenation component. The concentration of hydrogen sulfide in the gas is not critical. Subsequently, hydrogen-containing gas is introduced into the reactor and permitted to flow through the catalyst at operating pressure. A suitable flow rate is the hydrogen flow rate provided hereinbelow. The hydrocarbon feed to be treated by the process can then be introduced into the reactor.

While the above sulfiding pretreatment is a convenient way of pretreating the catalysts, other suitable methods known to those skilled in the art can be employed. For example, carbon disulfide can be added to the zone containing the catalyst or light hydrocarbon oil containing sulfur can be passed over the catalyst for a time that is sufficient to provide the appropriate metal sulfides to provide the appropriate metal sulfides on the catalysts.

Since some of the feedstocks that can be treated by the process of the present invention will contain arsenic and other metals that are detrimental to the catalyst of the process of the present invention, a guard chamber can appropriately precede the reaction zone of the process of the present invention. This guard chamber can contain a porous refractory inorganic oxide or absorbent, such as a cheap or used catalyst. Such material should remove from the feedstock and retain efficiently such deleterious metals.

The following example illustrates the invention:

EXAMPLE

The process of the present invention was used to convert a deashed, demetallized shale oil to JP-4 boiling range material. Table I, below, sets forth the properties of the raw, deashed and demetallized feedstock:

TABLE I

| SHALE OIL PROPERTIES | Raw | Demetallized |
|---|---|---|
| Carbon, wt % | 84.34 | 85.88 |
| Hydrogen, wt % | 11.76 | 12.46 |
| Nitrogen, wt % | 1.37 | 1.08 |
| Oxygen, wt % | 1.87 | 0.35 |
| Sulfur, wt % | 0.65 | 0.23 |
| API gravity, | 22.9 | 26.4 |
| Viscosity, cts (40° C.) | | 18.5 |
| Pour Point, °F. | | 40 |
| Arsenic, ppm | 24(23)a | 1.7 |
| Iron, ppm | 57 | 2 |
| Nickel, ppm | 10 | 1.5 |
| Other metals, ppm | 25 | 5 |
| Ash, oxide, wt % | 0.13(0,003)a | 0.0 |
| Oils, wt % | 61.8 | 67.9 |
| Resins, wt % | 38.1 | 32.0 |
| Asphaltenes, wt % | 0.1 | 0.1 |
| IBP-360°, wt % | 1.6 | 2.7 |
| 360°-650°, wt % | 38.0 | 42.9 |
| 650°F.+, wt % | 60.4 | 54.0 |
| 1000°F.+, wt % | 16.4 | 6.0 |

The catalysts used in the present example were prepared to have the following compositions, prior to sulfiding:

Catalyst A—1.6% $P_2O_5$, 3.2% NiO, 17.7% $MoO_3$, balance alumina.

Catalyst B—1.5% CoO, 10% $Cr_2O_3$, 15% $MoO_3$, balance 50% US (ultrastable) molecular sieve, 50% alumina.

The catalysts were tested in an automated hydrotreating pilot plant. This small-scale test unit had automatic controls for pressure, reactant flow and temperature. The reactor was made from ⅜ inch—inside diameter high pressure pipe. A ⅛-inch thermowell containing an axially traversing thermocouple extended through the center of the reactor. The reactor was heated by four separately controlled heating circuits to ensure isothermal temperature control.

The catalysts were ground to 14/20 mesh (Tyler) and calcined at 1000° F. for at least one hour prior to loading into the reactor. Catalyst B was loaded into the reactor from the bottom up. Support from the catalyst was provided by inert balls at the bottom of the reactor. Catalyst A, in a volume amount equal to that of catalyst B, was loaded into the reactor atop catalyst B. The space above catalyst A was loaded with inert balls.

After the catalysts were loaded into the reactor, it was subjected to the following sulfiding pretreatment. The temperature of the catalyst bed was raised to about 300° F. (149° C.) and a gas mixture of 8% hydrogen sulfide in hydrogen was passed through the catalyst bed at a variable pressure. At the end of approximately 1 hour, the temperature was raised to about 400° F. (371° C.) and the hydrogen sulfide-hydrogen gas mixture was passed through the catalyst for an additional hour, at which time its flow was stopped. At least one standard cubic foot of hydrogen-hydrogen sulfide gas, and preferably at least one standard cubic foot per hour, had been passed through the catalyst bed.

Following sulfiding, hydrogen gas was introduced into the reactor and allowed to flow at a pressure of 2000 psi and a flow rate of about 15 liters per hour. The positive pressure feed pump was started, the demetallized shale oil feedstock was permitted to flow through the reactor, and the temperature of the reactor was raised to the initial reaction temperature. Effluent from the reactor was passed into a gas-liquid high-pressure separator, wherein the gas was separated from the liquid. The gas was passed through a pressure control valve and a wet test meter to an appropriate vent. The liquid product was passed through a pressure control valve to a liquid product receiver.

The start-of-run conditions were: 774° F., 0.6 LHSV (1.2 LHSV over each catalyst) and 2000 psig. Temperature and space velocity were adjusted over the first 30 days on oil, to achieve stable product qualities, to 780° F. and 0.48 LHSV, respectively.

The reactor was operated for 6 months. The results obtained from the conversion of shale oil through day 145 are shown in Table II, below. On day 161 the feedstock was replaced with a denitrogenated feedstock containing about 210 ppm nitrogen to obtain data required for calculation of the temperature response, or activation energy, for JP-4 production.

TABLE II

| | TEST DATA | | | | |
|---|---|---|---|---|---|
| DAYS ON STREAM | 24 | 55 | 82 | 124 | 145 |
| Temperature, °F. | 778.2 | 779.8 | 779.8 | 783.0 | 787.6 |
| LHSV, $hr^{-1}$ | 0.6 | 0.48 | 0.48 | 0.48 | 0.48 |
| API Gravity, ° | 45.1 | 49.8 | 45.9 | 48.7 | 48.5 |
| Carbon, wt % | 86.1 | 85.96 | 86.24 | 85.97 | 85.96 |
| Hydrogen, wt % | 13.85 | 14.02 | 13.76 | 14.03 | 14.02 |
| Nitrogen, ppm | 3.5 | 0.8 | 1.6 | 1.5 | 2.7 |
| Sulfur, ppm | 412 | 155 | 14 | 29 | 120 |
| IBP, °F. | 135 | 44 | 91 | 17 | 0 |
| IBP-350° F., wt % | 25.6 | 45.6 | 30.5 | 38.4 | 41.0 |
| 360-650° F., wt % | 57.8 | 48.4 | 55.1 | 51.7 | 52.5 |
| 650° F., wt % | 16.6 | 6.0 | 14.4 | 9.9 | 6.5 |
| FBP, °F. | 891 | 787 | 875 | 836 | 776 |
| Gas Rate SCFB × $10^{-3}$ | 17.5 | 20.1 | 22.3 | 22.6 | 25.5 |
| Hydrogen Cons., SCFB | 1145 | 1330 | 1140 | 1330 | 1400 |
| wt % $C_1$-$C_4$ on feed | 3.4 | 5.3 | 4.5 | 5.1 | 6.1 |
| Volume Expansion, % | 107.7 | 108.7 | 107.0 | 108.2 | 107.2 |
| JP-4, wt % | 54.6 | 76.3 | 60.11 | 69.0 | 69.8 |

Samples from days 1 through 152, excluding samples from days 10 (reactor flooded) and 59 (valve failure), were composited. Samples of JP-4 boiling range material and 520° F.+ material were obtained from distillations of the composited product. Table III, below, details analytical data for the composite material, the JP-4 material and the 520° F.+ material.

TABLE III

| | PRODUCT QUALITIES | | |
|---|---|---|---|
| Type | Composite | JP-4 | 520° F.+ |
| API ° 47.1 | 49.0 | 41.3 | |
| Weight Percent | 100 | 70.4 | 29.0 |

TABLE III-continued

| | PRODUCT QUALITIES | | |
|---|---|---|---|
| Type | Composite | JP-4 | 520° F.+ |
| Volume Percent | 100 | 71.2 | 28.1 |
| Carbon, wt % | 85.67 | 85.83 | 85.57 |
| Hydrogen, wt % | 14.30 | 14.16 (13.6) | 14.41 |
| Nitrogen, ppm | 3.5 | 1.5 | 9.4 |
| Sulfur, ppm | | 48 | |
| Pour Point, °F. | | <−75 | |
| Aromatics, Vol % | | 18.5 (25.0) | |
| Olefins, Vol % | | 1.0 (5.0) | |
| Distillation, °F., D-2887 | | | |
| IBP | 30 | 46 | 497 |
| 10% | 208 | 192 | 530 |
| 20% | 270 | 242 (266) | 558 |
| 30% | 321 | 280 | 577 |
| 40% | 375 | 319 | 596 |
| 50% | 423 | 354 (365) | 617 |
| 60% | 461 | 391 | 645 |
| 70% | 512 | 424 | 676 |
| 80% | 577 | 452 | 717 |
| 90% | 657 | 485 (482) | 772 |
| EP | 845 | 582 (608) | 881 |

(Values in parentheses represents maximum (minimum for hydrogen content) specification limits)

As indicated above, JP-4 yields were 70 weight percent on liquid product. The product quantities indicate that a specification JP-4 fuel was produced.

Various modifications may be made to the invention as described without departing from the spirit of the invention or the scope of the appended claims.

We claim:

1. A process for hydrocracking a hydrocracking feedstock with hydrogen at hydrocracking conversion conditions which comprises sequentially contacting said feedstock with a first catalyst comprising about 0.5 to 10 wt % NiO, 12 to 22 wt % $MoO_3$, and about 0.1 to 3 wt % $P_2O_5$, balance alumina, and a second catalyst comprising about 0.5 to 5 wt % CoO, about 5 to 20 wt % $Cr_2O_3$ and about 10 to 20 wt % $MoO_3$, balance a support consisting essentially of crystalline molecular sieve material and alumina, said sieve material being present in an amount ranging from about 10 to about 60 wt % of total weight.

2. The process of claim 1 wherein said first catalyst comprises about 1 to 6 wt % NiO, about 15 to 20 wt % $MoO_3$ and about 0.5 to 2.7 wt % $P_2O_5$.

3. The process of claim 1 wherein said first catalyst comprises about 2 to 4 wt % NiO, about 16.5 to 18.5 wt % $MoO_3$ and about 1.0 to 2.2 wt % $P_2O_5$.

4. The process of claim 1 wherein said first catalyst consists essentially of about 3.2 wt % NiO, about 17.7 wt % $MoO_3$ and about 1.6 wt % $P_2O_5$, balance alumina.

5. The process of claim 1 wherein said second catalyst comprises about 0.5 to 3 wt CoO, about 5 to 15 wt % $Cr_2O_3$ and about 11 to 19 wt % $MnO_3$.

6. The process of claim 1 wherein said second catalyst comprises about 1 to 2 wt % CoO, about 8 to 12 wt % $Cr_2O_3$ and about 13 to 17 wt % $MnO_3$.

7. The process of claim 1 wherein said second catalyst consists essentially of about 1.5 wt % CoO, about 15 wt % $MoO_3$ and about 10 wt % $Cr_2O_3$, balance 50% US molecular sieve and 50% alumina.

8. The process of claim 1 wherein said feedstock is a shale oil.

9. The process of claim 1 wherein said first and second catalyst are deposed in separate beds of the same reactor vessel.

10. The process of claim 1 wherein said first and second catalysts are deposed in separate reactor vessels.

* * * * *

UNITED STATES PATENT AND TRADEMARK OFFICE

CERTIFICATE OF CORRECTION

PATENT NO. : 4,950,383

DATED : August 21, 1990

INVENTOR(S) : Andrew M. Tait et al

It is certified that error appears in the above-identified patent and that said Letters Patent is hereby corrected as shown below:

Col 3, line 21, "moleybdenum" should read ---molybdenum---.

Col 4, line 35, "off" should read ---of---.

Col 5, line 21, "shaped" should read ---shape---.

Col 6, line 35, before "The" add ---Note a -- values in parentheses reflect values after deashing.---.

Col 7, Table II, last entry in the column labeled "82", the value "60.11" should read ---60.1---.

Col 8, line 21, "represents" should read ---represent---.

Col 8, claim 5, line 3, "$MnO_3$" should read ---$MoO_3$---.

Col 8, claim 6, line 3, "$MnO_3$" should read ---$MoO_3$---.

Signed and Sealed this

Eleventh Day of February, 1992

*Attest:*

HARRY F. MANBECK, JR.

*Attesting Officer*

*Commissioner of Patents and Trademarks*